US005733045A

United States Patent [19]

Jostler et al.

[11] Patent Number: 5,733,045

[45] Date of Patent: Mar. 31, 1998

[54] WEB FOR PACKAGE BLANKS AND METHOD

[75] Inventors: Jan Jostler; Ingemar Broden, both of Halmstad, Sweden

[73] Assignee: Joker System Aktiebolag, Halmstad, Sweden

[21] Appl. No.: 553,510

[22] PCT Filed: May 5, 1994

[86] PCT No.: PCT/SE94/00418

§ 371 Date: Nov. 3, 1995

§ 102(e) Date: Nov. 3, 1995

[87] PCT Pub. No.: WO94/25365

PCT Pub. Date: Nov. 10, 1994

[30] Foreign Application Priority Data

May 5, 1993 [SE] Sweden ..... 9301561

[51] Int. Cl.[6] ..... B65D 33/14

[52] U.S. Cl. ..... 383/37; 53/284.7; 53/469; 53/479; 383/94

[58] Field of Search ..... 53/469, 479, 371.7, 53/284.7; 383/37, 94

[56] References Cited

U.S. PATENT DOCUMENTS

| | | | |
|---|---|---|---|
| 3,813,845 | 6/1974 | Weikert | 53/469 |
| 4,514,962 | 5/1985 | Ausnit | 53/469 |
| 4,558,556 | 12/1985 | Jostler | 53/459 |
| 4,630,311 | 12/1986 | Bentson | 383/37 |
| 4,654,878 | 3/1987 | Lems | 383/37 |
| 4,665,552 | 5/1987 | Lems et al. | 383/37 |
| 4,832,505 | 5/1989 | Ausnit et al. | 383/37 |

FOREIGN PATENT DOCUMENTS

| | | |
|---|---|---|
| 54564 | 9/1985 | European Pat. Off. . |
| 2157072 | 11/1971 | Germany . |
| 434042 | 7/1984 | Sweden . |

*Primary Examiner*—Stephen P. Garbe
*Attorney, Agent, or Firm*—Ladas & Parry

[57] ABSTRACT

A continuous flexible web (20) with mutually subsequently disposed package pockets (26) and a method of opening and filling these pockets. The web has two opposite walls (21*a*, *b*) and longitudinal first and second edges (22, 23) between which the pockets are located. Each respective wall (21*a*, *b*) includes, at a second edge region (23), two opposed edge portions (24*a*, *b*) with continuous retainer devices (43*a*, *b*) disposed in the longitudinal direction of the web for cooperating with mechanical devices for guiding the edge portions on movement of the web in an apparatus for the supply of material to the pockets (26). Between the pockets, there are disposed transverse slots (27) which, in the region of the edge portions (24*a*, *b*) merge into longitudinal slots (29). The edge portions (24*a*, *b*) include strip-like portions (14*a*, *b*) which extend from the retainer devices (43*a*, *b*) located between the longitudinal slots (29) and the second edge (23) of the web. The edge regions (24*a*, *b*) of the walls are displaced away from one another to open the pocketsand permit them to be filled after which the edge portions are displaced towards one another to close the pockets. On closure, the edge regions (24*a*, *b*) are kept adjacent one another and the longitudinal slots (29) are covered by strips (14*a*, *b*) which are folded over the retainer devices and fixed to outer surfaces of the respective walls (21*a*, *b*).

11 Claims, 6 Drawing Sheets

WEB FOR PACKAGE BLANKS AND METHOD

FIELD OF THE INVENTION

The present invention relates to a web comprising mutually subsequently disposed package blanks (pockets) and a method of filling the pockets of the web.

BACKGROUND AND PRIOR ART

There is a need in the art for a web comprising mutually subsequently disposed pockets in which the web is disposed to be moved along mechanical retainer devices which, in such instance, hold the pockets in the open position in order to make it possible to supply contents to the pockets. Once the contents have been supplied, the pockets are to be closed.

EP-B1-0 054 564 describes a web of the above type. The web displays two opposing walls and longitudinal first and second edges. The web includes mutually subsequently disposed pockets with a bottom portion at the first edge and two connection zones which are directed transversely in relation to the longitudinal direction of the web and which form side closures of the pockets. Transverse slots are provided between the connection zones in two mutually adjacent pockets in order to separate the pockets from one another.

The web includes two substantially opposing strip portions which extend in the longitudinal direction of the web at its above-disclosed second edge. Each strip portion is provided with a continuous retainer device for cooperation with mechanical guide members for keeping the strip portions in spaced apart relationship from one another and thereby for holding the pockets in opened positions in connection with contents being fed into the pockets. In both walls, the web is provided with slots disposed in the longitudinal direction of the web, each one of which being located on either side of the above-mentioned transverse slots, whereby two slots disposed adjacent one another in the longitudinal direction of the web are located in spaced apart relationship from one another.

Once the contents have been supplied to the pockets, these are closed in a region below the slots disposed in the longitudinal direction of the web, whereafter the material between the closure and the second edge of the web is removed from the web. This results in an undesirably large quantity of the material of the web being removed from the web once the pockets have been supplied with their contents. This removed material merely constitutes material waste.

SUMMARY OF THE INVENTION

The present invention provides a web and a method of filling the web, in which the above-outlined material wastage is eliminated. This is achieved by folding the strip portion over and around the retainer devices into facing relation with the outer surfaces of the walls of the web to cover the longitudinal slots, and welding the strip portions to the walls.

BRIEF DESCRIPTION OF THE DRAWINGS

The present invention will now be described in greater detail hereinbelow, with particular reference to the Drawings, in which.

DETAILED DESCRIPTION OF PREFERRED EMBODIMENTS

Figure 1A:
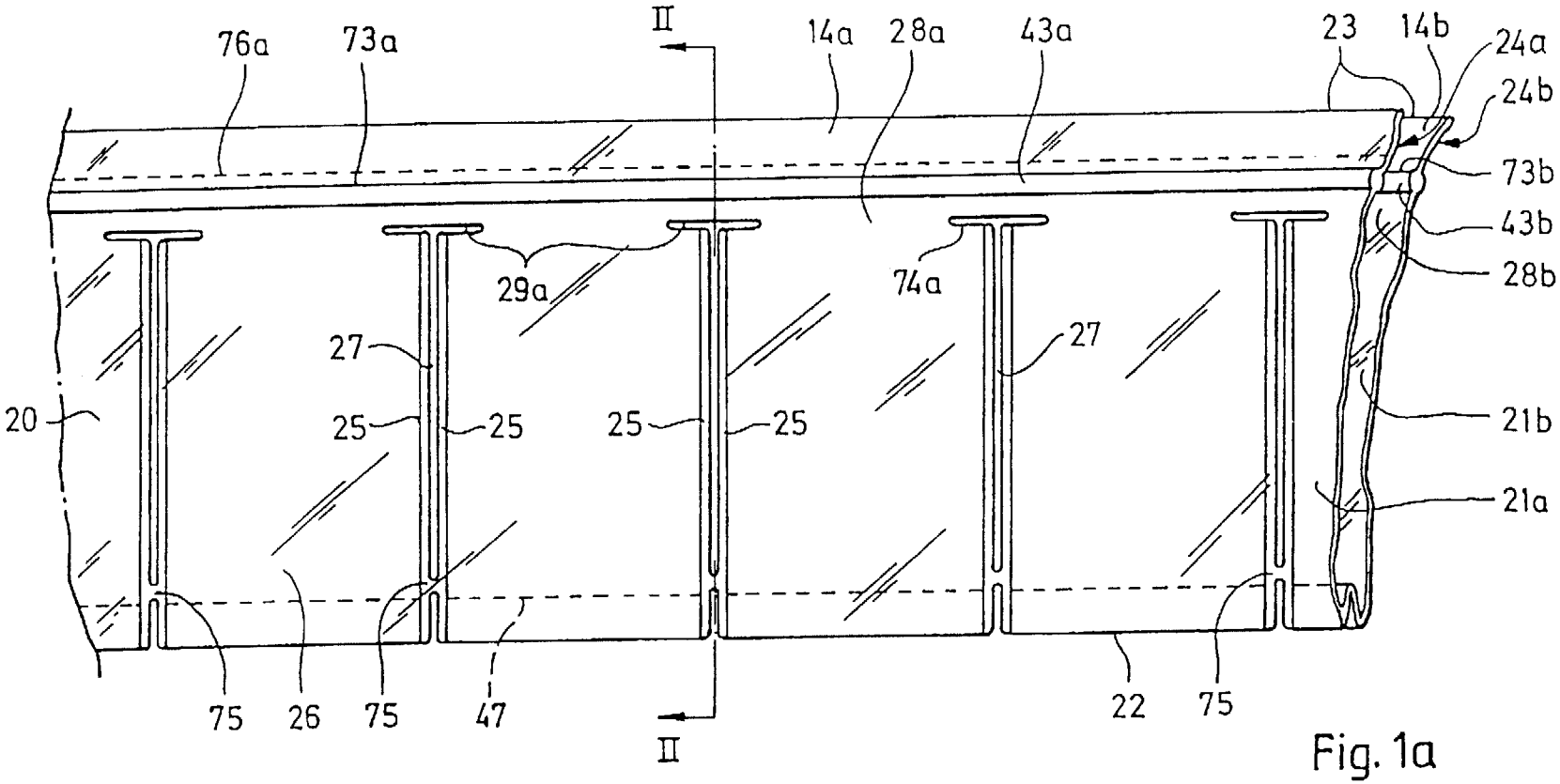
FIGS. 1*a,b* are perspective views of embodiments of one portion of a web according to the present invention.
Figure 1B:
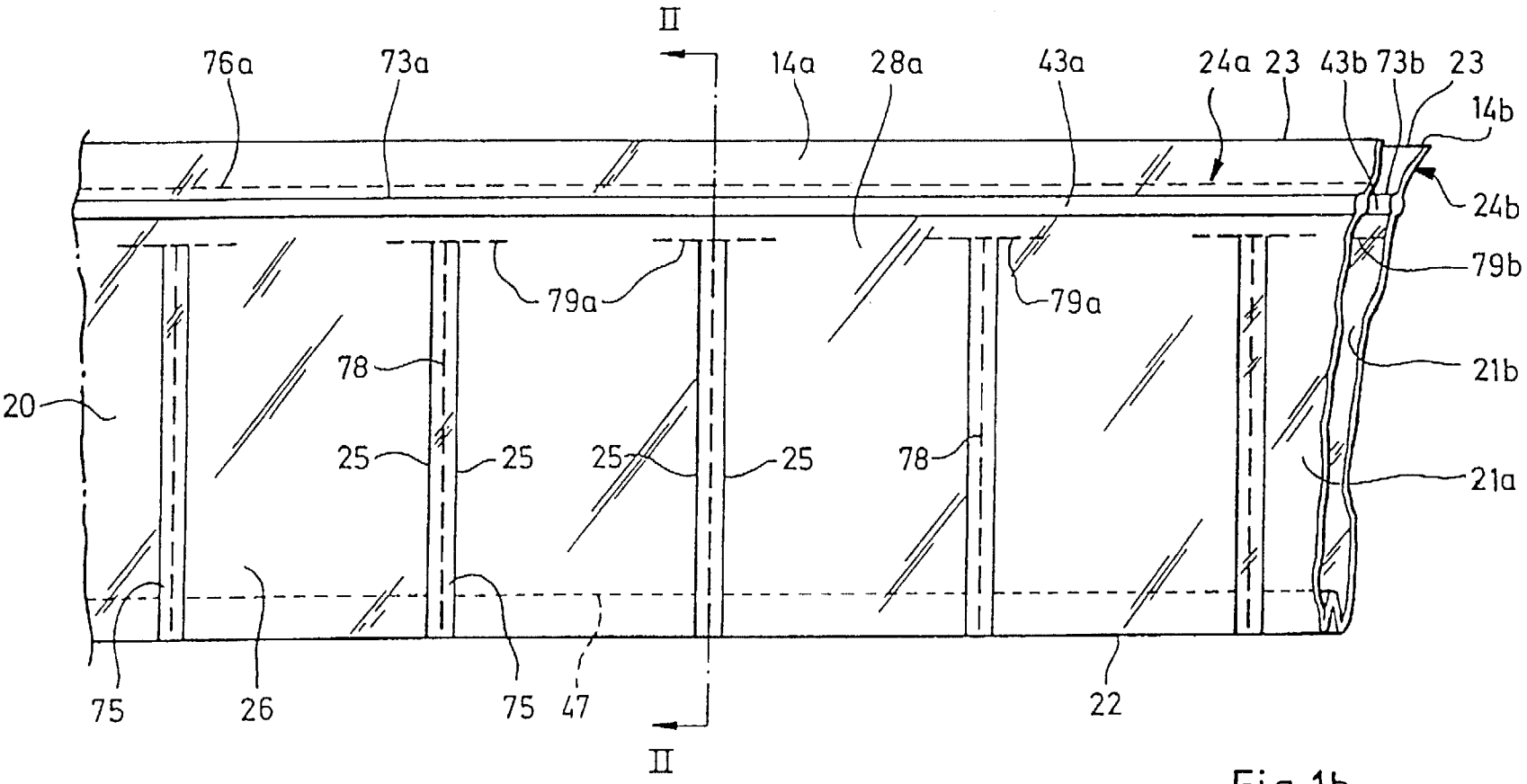

FIGS. 1*a,b* and 2*a,b* show one embodiment of a continuous web 20 of flexible material, as a rule plastic material or similar material. The term "similar material" is taken to signify any optional material possessing such properties that a web of the material is suitable for use in the practical application of the invention described herein. The web displays two opposing walls 21*a,b* and longitudinal first and second edges 22 and 23, respectively, and includes a number of mutually subsequently disposed package blanks or pocket 26. The pockets each have a bottom portion at the above-mentioned first edge 22 and two connection zones or joints 25 which are transversely directed in relation to the longitudinal direction of the web and are designated transverse zones or transverse joints 25 which form the side closures of the pockets. In FIGS. 1*a,b* and 2*a,b* the web is shown in one embodiment with an inwardly folded bottom. The upwardly directed bounding definition of the inwardly folded bottom carries reference numeral 47. It will be obvious to a person skilled in the art that, in other embodiments, both walls of the pockets directly merge into one another so as to form the bottom of the pockets, without any folded-in portion. Between the joints of two adjacent pockets, there is a transverse slot 27 which forms a separation means for separation of the pockets from one another. In certain embodiments, the transverse slot is wholly or partly replaced by a weakened portion in the material, for example a perforation 78. Mutually adjacent pockets 26 are normally united with one another by means of one or more bridges 75. In such instance, such bridges are as a rule disposed at least in the proximity the first edge 22 of web.

Each respective wall 21*a,b* includes two opposing edge portions 24*a,b* which extend in the longitudinal direction of the web at its above-mentioned second edge 23, each one including a continuous retainer device 43*a,b* for cooperation with mechanical devices 33*a,b* (cf. FIG. 3) for guiding the edge portions 24*a,b* on displacement of the web 20 into an apparatus 3 for supplying material to the pockets 26. The retainer devices are in the form of thickened portions.

Figure 2B:
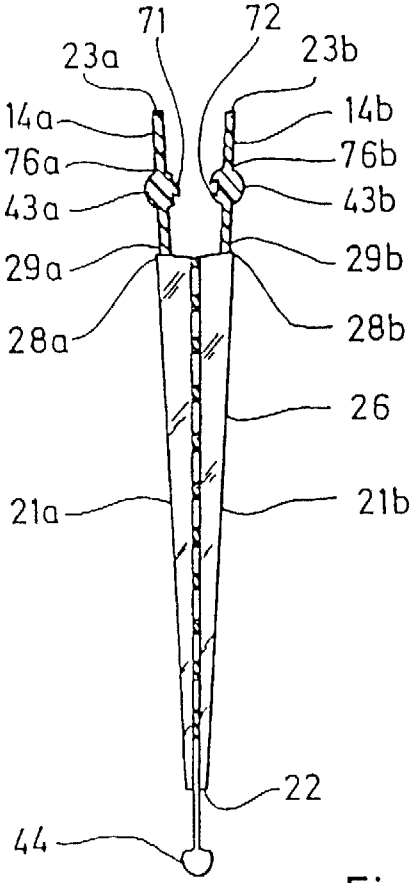
FIGS. 2*a,b* are sections taken along the line II—II in FIG. 1 in alternative embodiments of the web.
Figure 2A:
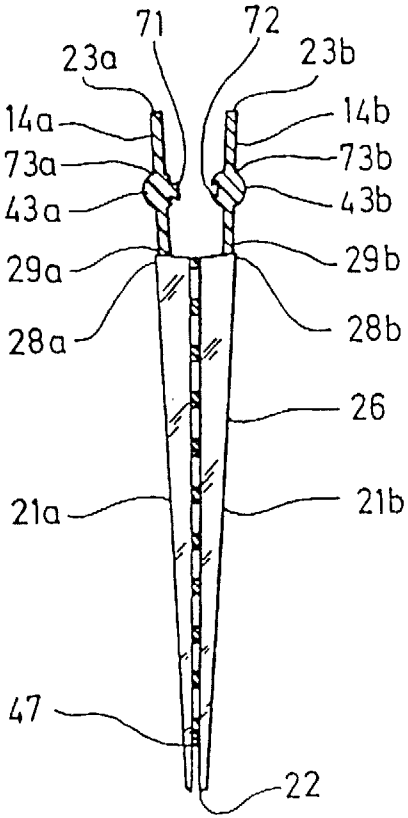

FIGS. 2*a* and 2*b* show one embodiment of the thickened material portions of the web where the thickened material portion 43*a* of the one wall 21*a* is provided with a bead 71 oriented in the longitudinal direction of the web, and the thickened material portion 43*b* of the second wall 21*b* is provided with a groove 72 oriented in the longitudinal direction of the web. The bead 71 and the groove 72 form male and female portions which tightly fit into one another and are preferably of a configuration which realizes a snap connection. In certain embodiments, tear-off means 76*a,b*, for example perforations, are provided above the retainer devices 43*a,b*.

At its end region located most proximal the retainer devices 43*a,b*, the extent of the transverse slot 27 in the longitudinal direction of the web is broadened by means of a perforation means or recess of an optional shape. As a rule, the recess is formed as a longitudinal slot 29 which is disposed on either side of each transverse slot 27. The longitudinal slot is located beneath the retainer devices 43*a,b*. The slots 29 which are connected to two mutually adjacent transverse slots 27, are located in spaced apart relationship from one another in the longitudinal direction of the web 20. In certain embodiments, the slot 29 have been replaced by weakened portions in the material, for example perforations 79*a,b*.

Each one of the edge portions 24*a,b* includes a strip-like portion 14*a,b* which forms the second edge 23 of the web. The strip-like portion 14*a,b* merge in a direction towards the pockets 26 into the retainer devices 43*a,b*. The connections of the strips to the retainer devices 43*a,b* carry reference numerals 73*a,b*, respectively. The width of the strip portions, i.e. their extent transversely of the longitudinal direction of the web, exceeds the greatest distance between the connections 73*a,b* and the bounding definitions 74*a,b* of the recesses 29 located most proximal the first end region 22 of the web, i.e. this width is selected such that the strips, after being folded over, extend over the walls 21*a,b* of the pockets 26. The material portions which are connected with one another when the pockets are closed carry reference numeral 28*a,b*.

FIG. 2*b* shows a second embodiment of the web where it is provided with a retainer device 44 (second retainer device) at the first end region 22 of the web. In FIG. 26, the retainer device 44 is shown in one embodiment in which it is a thickened material portion. The web in the embodiments illustrated in FIGS. 2*a,b* is intended to be employed in practical applications where, in connection with filling and/or emptying of the pockets of the web, the web is stretched in a transverse direction while both of its end regions 22,23 are fixed.

Figure 3:
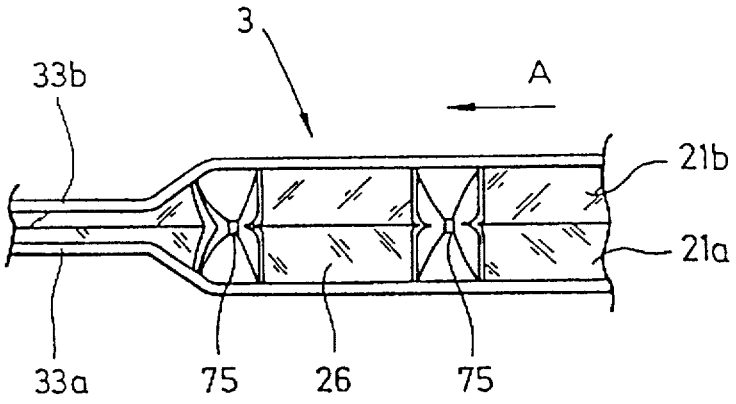
FIG. 3 is a schematic top plan view of a filling station.

The embodiment illustrated in FIG. 3 relates to a first station 3 (filling station) in which the web is displaced in the direction of the arrow A along the mechanical devices 33*a,b*. In order to facilitate the introduction of its contents into the pockets 26, the retainer devices 43*a,b* and thereby the edge portions 24*a,b* are held apart in the first station 3 by the mechanical devices 33*a,b*. In the left-hand portion of the Figure, the mechanical devices 33*a,b* switch to positions in which the devices are placed adjacent to one another. As a result, on displacement of the web 20, its walls 21*a,b* are moved to positions adjacent to one another, i.e. to positions in which the closure of the pockets takes place in that the walls 21*a,b* are connected in the material portions 28*a,b*. The function of the slots 29 is also apparent from FIG. 3, i.e. that the slot make it possible to displace the retainer devices 43*a,b* of the web transversely of the longitudinal direction of the web by increasing the distance between the pockets in their mouth or opening regions. The maximum distance between the mechanical devices 33*a,b*, and thereby the size of the mouth portion of the pocket transversely of the web 20 is determined by the length of the recess in the longitudinal direction of the web 20.

FIGS. 4 and 4*a–f*, respectively, show one embodiment of a second station 4 (folding stations) which follows after the filling station 3. The direction of displacement is also indicated by the arrow A here. From the mechanical devices 33*a,b*, the web 20 passes folding devices 37 in which the wall portions or strips 14*a,b* are folded down over the retainer devices 43*a,b* of the web for abutment against and securement to the walls 21*a,b* of the web in a region beneath the retainer devices.

The folding devices 37 are provided with abutment surfaces 38*a,b* which, in the direction of displacement of the web, continuously turn through 180° degrees from the orientation of the abutment surfaces in the region where the strips 14*a,b* enter the second station 4. When the web departs from the region of the folding devices, the strips 14*a,b* are in the positions shown in FIG. 4*c*.

Figure 4:
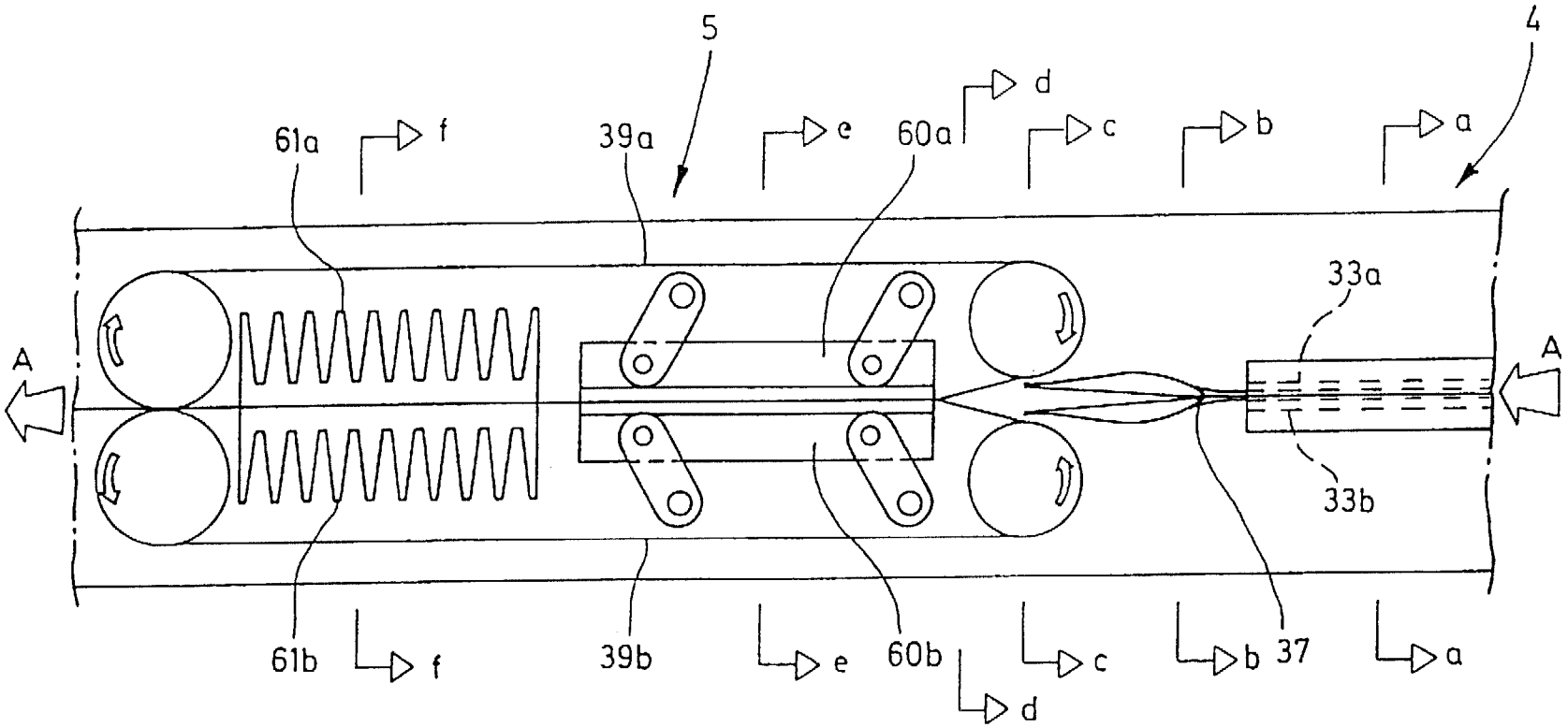
FIG. 4 is a top plan view of one embodiment of a folding and sealing station in the apparatus.
Figure 4A:
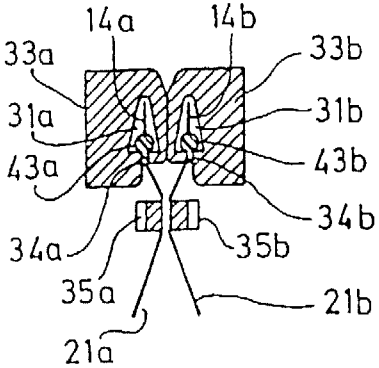
FIGS. 4*a–f* are the sections A–F in FIG. 4.
Figure 4D:
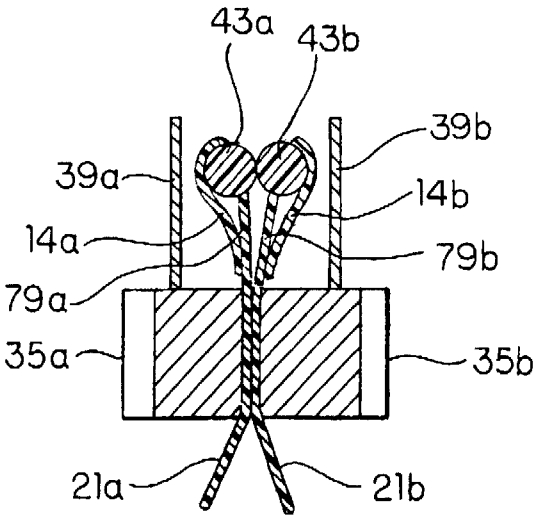
Figure 4B:
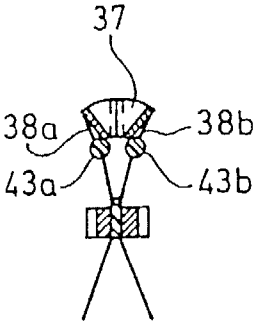
Figure 4E:
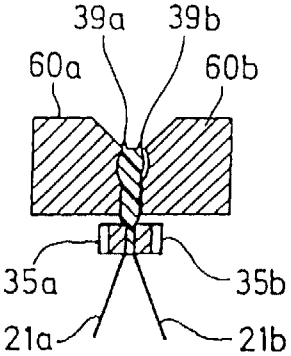
Figure 4C:
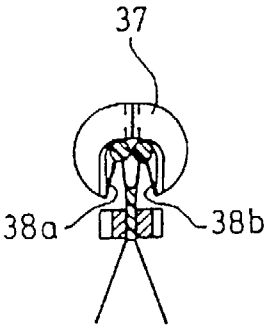
Figure 4F:
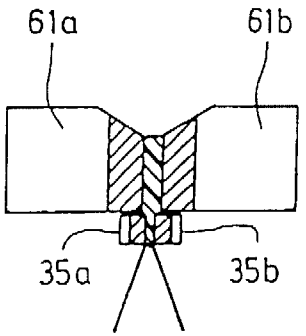

After the folding devices, there follows a third station 5 (welding station) in the direction of displacement of the web, this station comprising two opposing welding devices 60*a,b* which in turn are followed by two opposing cooling devices 61*a,b*. Two endless belts 39*a,b* are provided for cooperation with the welding devices 60*a,b* and the cooling devices 61*a,b*. The belts consist of a heat resistant flexible material, for example TEFLON. Both the welding devices 60*a,b* and the cooling devices 61*a,b* are disposed to be moved to and from the working positions illustrated in FIG. 4, i.e. in those positions where they press both opposing walls 21*a,b* of the web 20 towards one another. FIG. 4*d* shows how the belts 39*a,b* are located in positions in which, on their displacement, they approach the folded strips 14*a,b*. FIG. 4*e* shows how the welding devices 60*a,b* press the web with folded-over strips 14*a,b* against one another while supplying heat to the web. Finally, FIG. 4*f* shows how the cooling devices 61*a,b* press against the web 20 (in which the folded-over strips 14*a,b* have been welded) for cooling the web.

FIGS. 4*a–f* also show two opposed driving belts 35*a,b* generally in the form of cogged driving belts. The driving belts are disposed beneath the folding device 37, the welding devices 60*a,b* and the cooling devices 61*a,b*. The driving belts secure the web between them and hold the web in a predetermined position in relation to the welding devices 60*a,b* and the cooling devices 61*a,b* under continuous or intermittent displacement of the web 20 in the direction of the arrows A.

As a rule, the first, second and third stations 3,4, and 5, respectively, constitute a mechanically composite unit.

In one preferred practical application of the present invention, the web 20 is displaced along the mechanical devices 33*a,b* which are shown in the Figures as suspension devices for the retainer devices 43*a,b* of the web, in one embodiment in which the retainer devices are designed as thickened material portions 43*a,b*. The mechanical devices 33*a,b* are each provided with respective channels 31*a,b* dimensioned so as to accommodate the thickened material portions 43*a,b*. Each one of the channels 31*a,b* is provided with a longitudinal gap 34*a,b* of a minimum extent in the transverse direction which is less than the width of the thickened portion 13*a,b* of each respective web wall 21*a,b*. As a rule, the mechanical devices are oriented such that the web is suspended in the mechanical devices 33*a,b* during displacement therealong. Other orientation of the mechanical devices and of the web is employed in certain practical applications of the invention.

In the filling station 3 (the first station) the mechanical devices 33*a,b* keep the retainer devices 43*a,b* of the web at a distance from one another, the maximum distance being determined by the length of the longitudinal slots 29*a,b*.

Once the intended contents have been supplied to the pockets 26 of the web, these pockets pass the folding station 4 (the second station), where the strips 14*a,b* projecting from the retainer devices 43*a,b* of the web are folded over and brought into abutment against the outer surfaces of walls 21*a,b* of the web. In one preferred embodiment, the strips 14*a,b* also cover the recesses 29*a,b* in the walls.

The filled pockets 26 thereafter pass to the third station 5 (the welding station). In this station, the pockets pass between the welding devices 60*a,b* where they are pressed by these devices and by the belts 39*a,b* located between the welding devices and the web, towards one another during simultaneous supply of thermal energy of an intensity and quantity which cause the walls 21*a,b* of the pockets 26 to be welded together at the same time as the folded-over strips are also welded sealingly to the walls 21*a,b* of the pockets. Thereafter, the pockets are advanced in between the cooling devices 61*a,b*.

The filling and closure process is completed when the pockets depart from the cooling devices 61*a,b*. Generally, the packages formed from the pockets 26 are then separated from one another by means not shown. As will be apparent from the foregoing description (cf. also FIGS. 4*a–f*), all material in the web is included in the finished, closed packages formed by the pockets. There will hereby be achieved the desired effect of eliminating material wastage as produced by the prior art technology.

The accumulation of material which occurs on closure of the package blanks when strips 14*a,b* are welded together with the walls 21*a,b*, when—a relatively thick and substantially integrated material portion at the welded region. This thicker material portion provides a reinforcement of the formed, closed package in the closure region, which in purely general terms may be of value in many practical applications. Moreover, the increased material thickness permits content residues which have remained in the region of the intended weld to be enclosed by the plastic material, a factor which ensures that a tight closure is obtained to seal the contents.

In the foregoing, the strips 14*a,b* projecting from the retainer devices 43*a,b* have been employed to cover the recesses, for example the longitudinal slots 29. It will be obvious that, in other practical applications of the present invention, use is made of separate strips in connection with the closure of the filled pockets, these strips being, for example, unwound from magazine reels in order to cover the recesses 29.

In those applications in which separate strips are employed in order, on closure of the package blanks, to be welded together with the walls 21*a,b* of the blanks, and in order to cover the recesses 29, certain practical applications of the present invention call for the use of the wall portions 14*a,b* located above the retainer devices for closing the package blanks. On welding of the strips to the walls 21*a,b* to cover the recesses 29, the walls are, in certain embodiments, then kept separated from one another by mechanical devices in order to avoid welding together of the walls. In embodiments in which the wall portions 14*a,b* located above the retainer devices are provided with tear-off means 76, closure of the package blank is effected by welding together of the wall portions 14*a,b* above the tear-off means 76. In those cases where the retainer devices are designed with male and female parts 71,72 for snap-in connection, the opened package is reclosable using these parts.

In many applications, the above described employment of a strip 14*a,b* which is folded over in order to cover the recesses 29 or which is supplied as a strip separate from the web achieves a desirable mechanical reinforcement of the upper portion of the filled pocket 26.

In the foregoing description, use has occasionally been made of the designations upper, lower, right, left, etc. These designations have been employed to facilitate the presentation of the invention. It will be obvious to a person skilled in the art that the technique described in the foregoing generally permits an optional spatial orientation of the web.

The above-detailed description has referred to but a limited number of embodiments of the present invention, but it will be readily be perceived by a person skilled in the art that the present invention accommodates a large number of embodiments without departing from the spirit and scope of the appended claims.

What is claimed is:

1. A package containing filling material comprising a web of flexible material extending longitudinally and having opposite walls facing one another, and first and second longitudinal edges, said walls being joined proximate said first longitudinal edge and being unconnected at said second longitudinal edge, said walls being provided with a plurality of transverse connection zones successively spaced longitudinally along said web to defining sides of pockets between adjacent connection zones, each pocket being closed at said first longitudinal edge, said transverse connection zones providing side closures for said pockets, separations between the connection zones of adjacent pockets for separating said pockets from one another, each wall comprising a retainer device proximate said second edge for cooperating with a mechanical device which guidably supports said retainer device and permits longitudinal displacement of said web in an apparatus which supplies filling material into said pockets, perforations in said walls extending longitudinally from said separations to enable said walls to be separated in said apparatus and form an open mouth for said pockets at said second edge at which said filling material can be introduced into said pockets, at least one of said walls including a strip-like portion extending from and beyond its respective said retainer device, said strip-like portion being foldable outwardly around its respective said retainer device to face an outer surface of the respective wall so that after filling of the pockets said strip-like portion can be welded to the respective wall, said strip-like portion having a width in the transverse direction sufficient to cover said perforations in the respective said wall when folded around its respective said retainer device.

2. A package as claimed in claim 1 wherein said retainer devices and said walls can also be welded to one another to form a weld joint which seals the mouth of the pockets.

3. A package as claimed in claim 1 wherein each of said walls includes a respective said strip-like portion.

4. A package as claimed in claim 1 wherein each retainer device comprises a thickened portion of said material of the web.

5. A package as claimed in claim 1 comprising bridges joining said walls together at said separations to connect adjacent pockets together.

6. A package as claimed in claim 1 wherein said separations includes slots or perforations.

7. A package as claimed in claim 1 wherein said perforations include slots or lines of perforations.

8. A package as claimed in claim 1 wherein the retaining devices in the opposite walls face one another and include releasable engaging means for closing the mouths of the pockets.

9. A method for producing packages filled with material, comprising:

providing a web of flexible material having opposite walls facing one another with first and second longitudinal edges, said walls being joined proximate said first longitudinal edge and being unconnected at said second longitudinal edge, said web being provided with successive transverse connection zones spaced longitudinally to define sides of pockets between adjacent connection zones, each pocket being closed in proximity to said first longitudinal edge, said transverse connection zones providing side closures for the sides of said pockets and having transverse separations for separating said pockets from one another, and perforations extending longitudinally from said separations in the region of said second longitudinal edge, providing a retainer device in each said wall between said perforations and said second longitudinal edge to provide a strip-like portion of material extending from the retainer device to said second longitudinal edge, guidably supporting the retainer devices of the walls on respective guides and longitudinally advancing said web on said guides to move said walls apart at said second longitudinal edge of the web to open said pockets as said pockets pass a filling station, filling each pocket with material at said filling station, moving said walls towards one another after filling said pockets with material, while outwardly folding said strip-like portions around said retainer devices into facing relation with outer surfaces of the respective walls and cover said perforations, sealing said strip-like portions to said walls, and sealing the mouth of the pockets.

10. A method as claimed in claim 9 wherein the mouths of the pockets are sealed by welding the retainer devices and the wails to one another.

11. A method as claimed in claim 9 wherein said strip-like portions are sealed to said walls by welding.

* * * * *